US009677388B2

(12) United States Patent
Johnson

(10) Patent No.: US 9,677,388 B2
(45) Date of Patent: Jun. 13, 2017

(54) MULTILATERAL SAND MANAGEMENT SYSTEM AND METHOD

(71) Applicant: Michael H. Johnson, Katy, TX (US)

(72) Inventor: Michael H. Johnson, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 393 days.

(21) Appl. No.: 14/289,725

(22) Filed: May 29, 2014

(65) Prior Publication Data

US 2015/0345264 A1 Dec. 3, 2015

(51) Int. Cl.
*E21B 43/12* (2006.01)
*E21B 41/00* (2006.01)
*E21B 43/08* (2006.01)

(52) U.S. Cl.
CPC ..... *E21B 43/12* (2013.01); *E21B 41/0035* (2013.01); *E21B 43/08* (2013.01); *E21B 43/128* (2013.01)

(58) Field of Classification Search
CPC .... E21B 41/0035; E21B 43/12; E21B 43/128; E21B 43/08
See application file for complete search history.

(56) References Cited

U.S. PATENT DOCUMENTS 2,707,997 A * 5/1955 Zandmer ..... E21B 33/14 166/100
3,326,291 A * 6/1967 Zandmer ..... E21B 43/11 166/100
3,347,317 A * 10/1967 Zandmer ..... E21B 43/086 166/100
5,477,925 A * 12/1995 Trahan ..... E21B 33/14 166/117.5
5,762,149 A * 6/1998 Donovan ..... B04B 1/08 166/265

(Continued)

FOREIGN PATENT DOCUMENTS

CA 2806772 A1 * 2/2012 ..... E21B 41/0035
WO WO 0106090 A2 * 1/2001 ..... E21B 41/0035

OTHER PUBLICATIONS

Herve Ohmer, et al., "Multilateral Junction Connectivity Discussion and Analysis" SPE 71667, Society of Petroleum Engineers, presentation at 2001 SPE annual Technical Conference and Exhibition, New Orleans, Louisiana, Sep. 30-Oct. 3, 2001, 99.

(Continued)

*Primary Examiner* — Jennifer H Gay
(74) *Attorney, Agent, or Firm* — Cantor Colburn LLP

(57) ABSTRACT

A multilateral sand management system including a multilateral junction device disposed at a multilateral junction area of a primary borehole and a lateral borehole. The multilateral junction device including a lateral leg disposed within an upholemost portion of the lateral borehole. An electric submersible pump disposed within the lateral leg of the multilateral junction device. The pump when operating placing the multilateral junction area under a positive pressure compared to a pressure in the lateral borehole and in the primary borehole downhole of the multilateral junction area. A method of controlling sand at a multilateral junction area of a primary borehole and a lateral borehole.

21 Claims, 3 Drawing Sheets

(56) References Cited

U.S. PATENT DOCUMENTS 6,089,322 A * 7/2000 Kelley ..... E21B 43/38 166/105.5
6,244,340 B1 * 6/2001 McGlothen ..... E21B 23/002 166/117.6
6,863,126 B2 * 3/2005 McGlothen ..... E21B 34/06 166/242.1
6,923,259 B2 8/2005 Snow
7,159,661 B2 * 1/2007 Restarick ..... E21B 41/0042 166/117.6
7,793,714 B2 * 9/2010 Johnson ..... E21B 34/063 166/205
8,505,627 B2 8/2013 Cox
2001/0025710 A1 * 10/2001 Ohmer ..... E21B 41/0042 166/313
2003/0056952 A1 * 3/2003 Stegemeier ..... E21B 43/00 166/250.12
2004/0055751 A1 3/2004 McGlothen et al.
2004/0055787 A1 * 3/2004 Zupanick ..... E21B 7/046 175/65
2004/0159429 A1 * 8/2004 Brockman ..... E21B 47/06 166/250.08
2005/0115713 A1 * 6/2005 Restarick ..... E21B 41/0042 166/313
2006/0108114 A1 * 5/2006 Johnson ..... E21B 43/04 166/276
2009/0173490 A1 * 7/2009 Dusterhoft ..... E21B 43/082 166/229
2009/0173497 A1 * 7/2009 Dusterhoft ..... E21B 43/025 166/276
2010/0051270 A1 * 3/2010 Dusterhoft ..... E21B 43/082 166/278
2011/0056688 A1 * 3/2011 Johnson ..... E21B 34/063 166/278
2011/0079388 A1 4/2011 Cox
2013/0081807 A1 * 4/2013 Dyer ..... E03B 3/14 166/254.2
2013/0319666 A1 * 12/2013 Nygardsvoll ..... E21B 41/0035 166/278
2013/0327572 A1 * 12/2013 Sponchia ..... E21B 41/0035 175/61
2014/0102716 A1 * 4/2014 Benson ..... E21B 43/08 166/381
2015/0275645 A1 * 10/2015 Gill ..... E21B 41/0042 166/303
2015/0337633 A1 * 11/2015 Legrand ..... E21B 47/011 166/276
2015/0345264 A1 * 12/2015 Johnson ..... E21B 43/12 166/311
2016/0024904 A1 * 1/2016 Zupanick ..... E21B 43/305 166/50

OTHER PUBLICATIONS

Jose Fraija, et al., "New Aspects of Multilateral Well Construction" Oilfield Review, Autumn 2002, www.slb.com, pp. 52-69.

Notification of Transmittal of the International Search Report and the Written Opinion of the International Searching Authority, or the Declaration; PCT/US2015/024076; Mail date Jul. 15, 2015; 7 pages.

* cited by examiner

MULTILATERAL SAND MANAGEMENT SYSTEM AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Many of the world's oil and gas wells produce from unconsolidated sandstones that produce formation sand with reservoir fluids. Problems that are associated with sand production include plugging of perforation tunnels, sanding up of the production interval, accumulation in surface separators, and potential failure of downhole and surface equipment from erosion. Soft formation wells require specialized sand control completion practices to allow hydrocarbons to be produced without formation sand. While it is important to effectively prevent sand production, it is equally important to do so in a way that does not hinder a well's productivity.

A multilateral borehole system includes at least a primary borehole and a lateral borehole extending therefrom. Multilateral boreholes generally require junctions at intersection points where lateral boreholes meet a primary borehole or where lateral boreholes meet (acting then as subprimary boreholes) other lateral boreholes. Multilateral junctions are typically Y-type constructions intended to create flow paths at borehole intersections and are generally referred to as having a primary leg and a lateral leg. The multilateral junction between the primary borehole and the lateral borehole in some cases is an avenue for sand and other particulate matter infiltration into the borehole system, which generally results in the entrainment of such particulate matter with the production fluid. Clearly, it is undesirable to produce particulate matter since those particulates would then need to be removed from the production fluid adding expense and delay to a final release of a product. The reasons for particulate infiltration through a junction in a multilateral borehole are many, including the not entirely controllable window size and shape which is generated by running a milling tool into the primary borehole and into contact with a whipstock, whereafter the mill tool mills a window in the casing of the primary borehole. The milling process itself is not precise and thus it is relatively unlikely that a precise window shape and size can be produced. Lateral liners that are run in the primary borehole to extend through a milled window and into a lateral borehole are constructed with regular patterns and sizes at the surface. When a regular pattern at the top of such a liner is seated against a milled window in the downhole environment, it is relatively unlikely that the liner will seat correctly in all regions of a milled window. This leaves gaps between the liner and the milled casing in the primary borehole resulting in the aforesaid avenue for infiltration of particulate matter to the borehole system.

In order to control sand production in this area, the prior art has proposed employing scaling materials in the area of the multilateral junction, as well as sleeves having a premachined window therein to ensure that a liner will seal there against.

The art would be receptive to improved and/or alternative apparatus and methods for reducing the amount of particulate matter infiltrating the wellbore system at a junction in a multilateral wellbore.

BRIEF DESCRIPTION

A multilateral sand management system including a multilateral junction device disposed at a multilateral junction area of a primary borehole and a lateral borehole, the multilateral junction device including a lateral leg disposed within an upholemost portion of the lateral borehole; and, an electric submersible pump disposed within the lateral leg of the multilateral junction device, the pump when operating placing the multilateral junction area under a positive pressure compared to a pressure in the lateral borehole and in the primary borehole downhole of the multilateral junction area.

A method of controlling sand at a multilateral junction area of a primary borehole and a lateral borehole, the multilateral junction area at least substantially spanning an inner diameter of the primary borehole, the method including positioning a multilateral junction device in the multilateral junction area with a lateral leg of the multilateral junction device within the lateral borehole; positioning an electric submersible pump into the lateral leg of the multilateral junction device; and, placing the multilateral junction area under a positive pressure via pumping action of the electric submersible pump.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
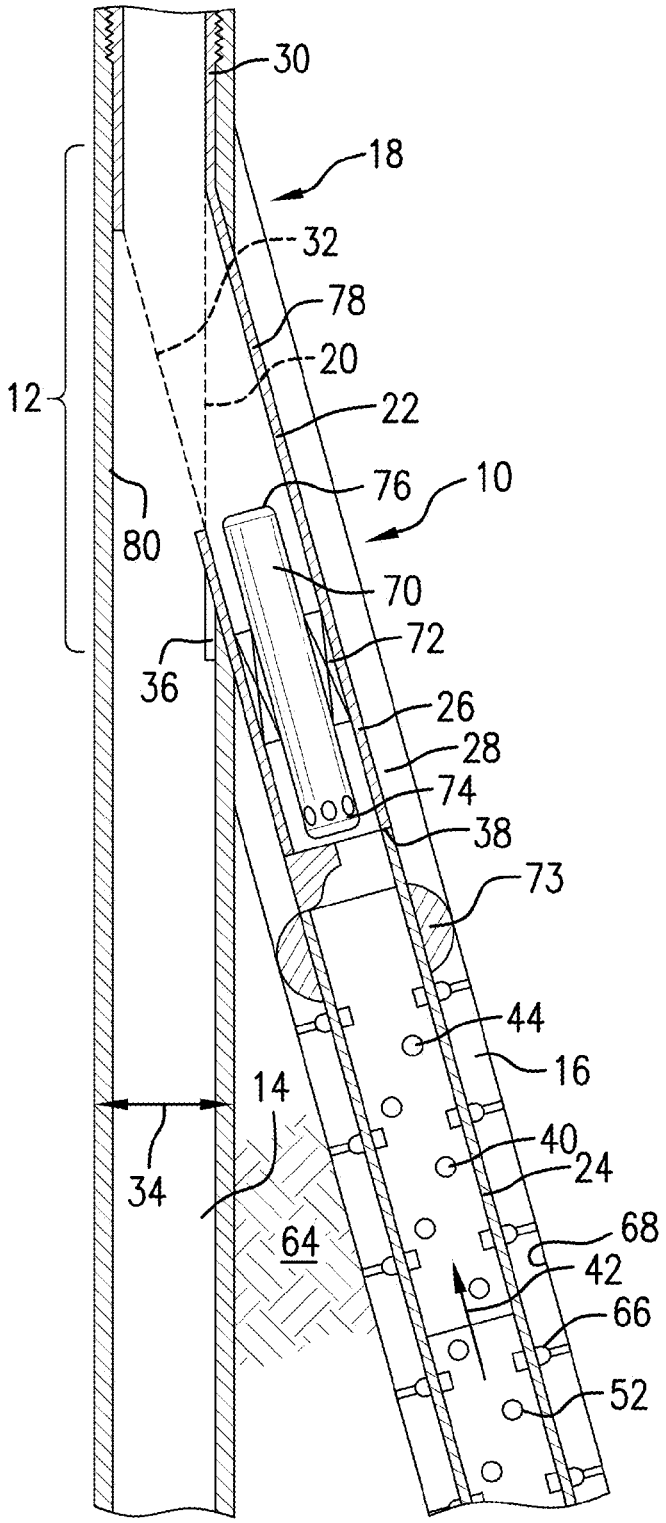
FIG. 1 shows a partial cross-sectional view of an exemplary embodiment of a multilateral sand management system.
Figure 2:
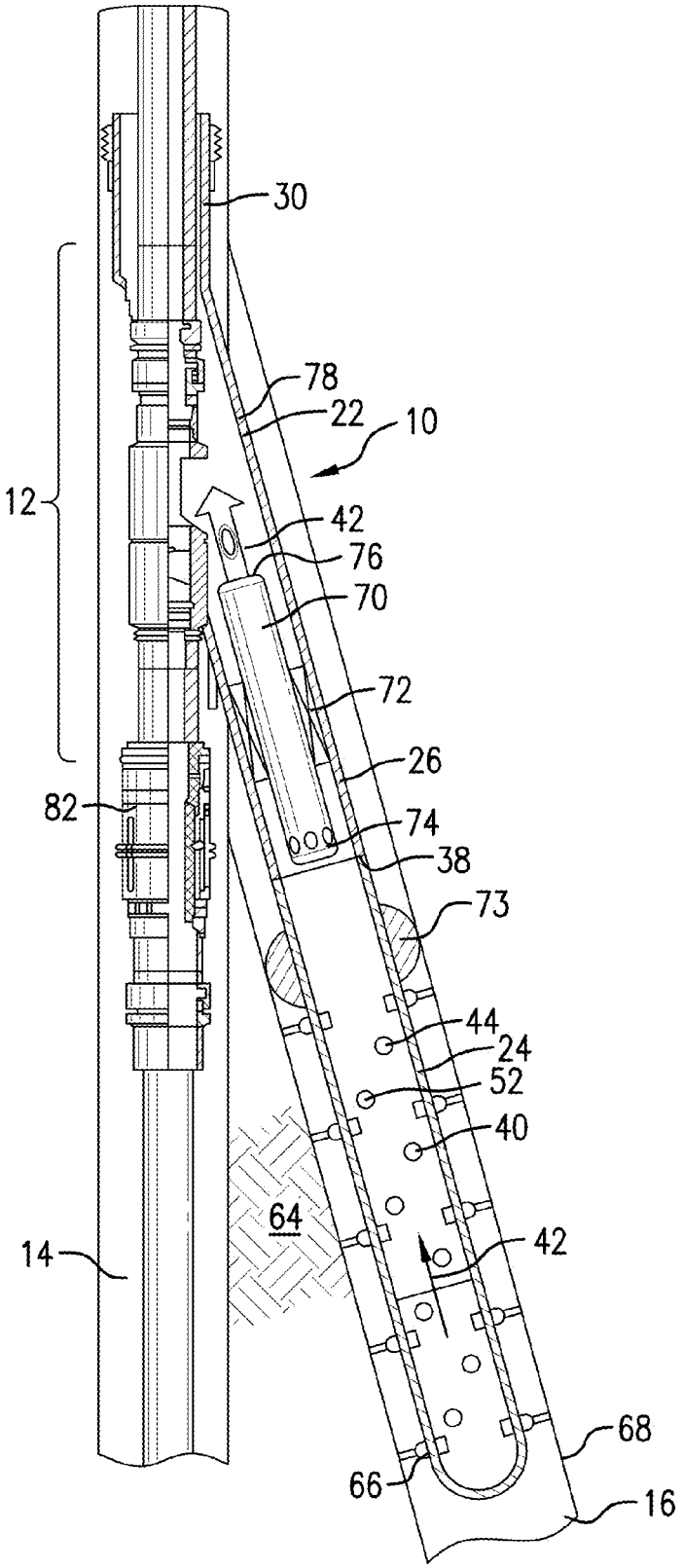
FIG. 2 shows a partial cross-sectional view of an exemplary embodiment of the multilateral sand management system of FIG. 1 with completion equipment disposed in a primary borehole.

FIGS. 1 and 2 show a multilateral sand management system 10 disposed at a multilateral junction area, generally designated at 12, between a primary borehole 14 and a lateral borehole 16. The multilateral junction area 12 is the area of the multilateral borehole 18 located in the area of the exit opening 20 (shown by dashed lines) of the lateral borehole 16 from the primary borehole 14. In other words, the multilateral junction area 12 is the intersection between the lateral borehole 16 and the primary borehole 14. A multilateral junction device 22 is placed at the multilateral junction area 12. The multilateral junction device 22 may be used to run a liner 24 into the lateral borehole 16, provide access into the primary borehole 14, and generally stabilize the multilateral junction area 12. While the term "multilateral junction" is sometimes used to indicate the device provided at the intersection (junction) between the primary borehole 14 and the lateral borehole 16, for the purposes of these exemplary embodiments, the term "multilateral junction device" will be used to differentiate the multilateral junction device 22 from the multilateral junction area 12 in which the device 22 is employed.

In the illustrated exemplary embodiment of the multilateral junction device 22, the multilateral junction device 22 includes a lateral leg 26 disposed within an uphole portion 28 of the lateral borehole 16, a primary leg 30 disposed within the primary borehole 14, and a window 32 (shown in dashed lines) providing access to the primary borehole 14 downhole of the multilateral junction device 22. When the multilateral junction device 22 is installed at the multilateral junction area 12, access to both the lateral borehole 16 and an area of the primary borehole 14 downhole of the multilateral junction device 22 is enabled. Also, to assist in stabilization of the multilateral junction area 12 and to provide the greatest amount of space allotted to production flow, the primary leg 30 spans at least substantially across an inner diameter 34 of the primary borehole 14. The window 32 allows for re-entry into the primary borehole 14 after completion of the junction area 12 between the lateral borehole 16 and the primary borehole 14. The window 32 also at least substantially spans an inner diameter 34 of the primary borehole 14. The hook 36 on the multilateral junction device 22 will stop the multilateral junction device 22 from further entry into the lateral borehole 14 at a location uphole of the lateral leg 26 because the hook 36 provides the multilateral junction device 22 an effective outside diameter larger than that of the exit opening 20 to the lateral borehole 16. The hook 36 may be one or more longitudinal lateral extensions welded or otherwise attached and protruding from one or more sides of the multilateral junction device 22. In an exemplary embodiment, the hook 36 includes a pair of lateral extensions on opposing sides of the window 32. Further details regarding an exemplary embodiment of the hook 26 of the multilateral junction device 22 may be found within U.S. Pat. No. 5,477,925, herein incorporated by reference in its entirety.

While a particular multilateral junction device 22 has been described and illustrated, alternative multilateral junction devices may also be employed, such as, but not limited to, a multilateral junction device having a primary leg extending downhole of the exit opening 20 of the lateral borehole 16, with a window in the primary leg, and a lateral leg extending through the window in the primary leg. As will be described below, employment of the multilateral sand management system 10 using the illustrated multilateral junction device 22 advantageously deters sand entry into the multilateral junction area 12 that may otherwise infiltrate the area 12. Due to irregularities of an open borehole, multilateral junction devices can be very difficult to seal against the entry of sand, and the multilateral sand management system 10 described herein provides an alternative to previously applied sealing practices.

Figure 3:
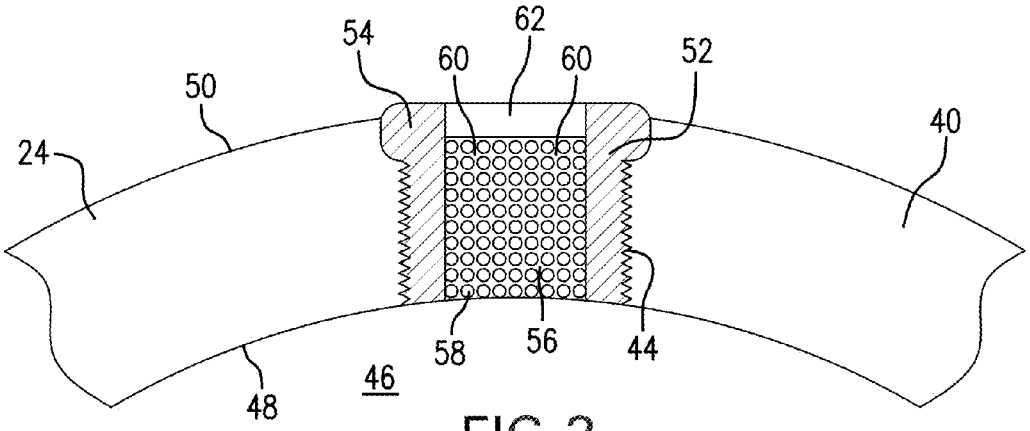
FIG. 3 shows a cross-sectional view of an exemplary embodiment of a filter puck for use in an exemplary sand control liner of the multilateral sand management system of FIGS. 1 and 2; and, FIG. 4 shows a cross-sectional view of an exemplary embodiment of a telescoping module for use in an exemplary sand control liner of the multilateral sand management system of FIGS. 1 and 2.

With further reference to the multilateral sand management system 10, the sand control liner 24 is attached to a downhole end 38 of the multilateral junction device 22. The sand control liner 24 may be sturdy and at least substantially inflexible so as to retain its inner diameter and not collapse inwardly. The sand control liner 24 includes a tubular-shaped wall 40 and an interior 46 (FIG. 3) providing a main flow path for production fluids from the lateral borehole 16 in an uphole direction 42. The wall 40 may include a plurality of spaced apertures 44 dispersed about the wall 40. The apertures 44 can extend from the interior surface 48 to the exterior surface 50 of the wall 40 and be sized to receive a filter puck 52 therein, such as shown in FIG. 3. The filter puck 52 includes a substantially tubular body 54 having an exterior periphery sized to engage with an inner periphery of the aperture 44, such as via male and female threads on cooperating surfaces of the body 54 and aperture 44. The filter pucks 52 may be substantially flush with the exterior surface 50 or may protrude from the exterior surface 50 of the sand control liner 24.

The filter puck 52 includes a filtering element 56 spanning an interior diameter or cross-sectional area of the body 54. In one exemplary embodiment of the filtering element 56, the filtering element 56 includes a bead pack 58 or bead screen including a matrix of bonded beads 60. The filtering element 56 is capable of preventing sand from entering into the interior 46 of the wall 40 of the sand control liner 24, but allows passage of production fluids there through. The bonded bead matrix itself is described as "beaded" since the individual "beads" 60 are rounded though not necessarily spherical. A rounded geometry is useful primarily in avoiding clogging of the matrix since there are few edges upon which debris can gain purchase. While the bead pack 58 may be bonded stainless steel beads having a brazed construction, the beads 60 can alternatively be formed of many materials such as ceramic, glass, and other metals, and selected for particular resistance to anticipated downhole conditions. The beads 60 may then be joined together, such as by sintering, for example, to form the bonded bead matrix of the bead pack 58 such that interstitial spaces are formed there between providing the permeability thereof. In some embodiment, the beads 60 may be coated with another material for various chemical and/or mechanical resistance, or with a hydrophobic coating that works to exclude water in fluids passing there through.

The filter pucks 52 may optionally include a dissolvable membrane 62 dissolvable in the presence of downhole fluids over time such that production fluids do not enter the interior 46 of the sand control liner 24 for a predetermined period of time. Alternatively, the dissolvable membrane 62 may be dissolved in the presence of an acid or other chemical selectively introduced at a time when production through the filter pucks 52 is desired. When the dissolvable membrane 62 is dissolved, the filtering element 56 remains intact and fluids may pass through the filtering element 56. An operator may selectively determine what type of filter puck 52 to insert within the sand control liner 24 based on a particular intended operation. Alternatively, a sand screen, such as a screen wrap (not shown), and slotted production tubular may be attached to the downhole end 38 of the lateral leg 26 of the multilateral junction device 22. However, due to the removal of a screen wrap, the sand control liner 24 can be enlarged to occupy the space previously occupied by the screen wrap, thus increasing the inner diameter allotted to production flow, which in these embodiments is the inner diameter of the sand control liner 24.

Figure 4:
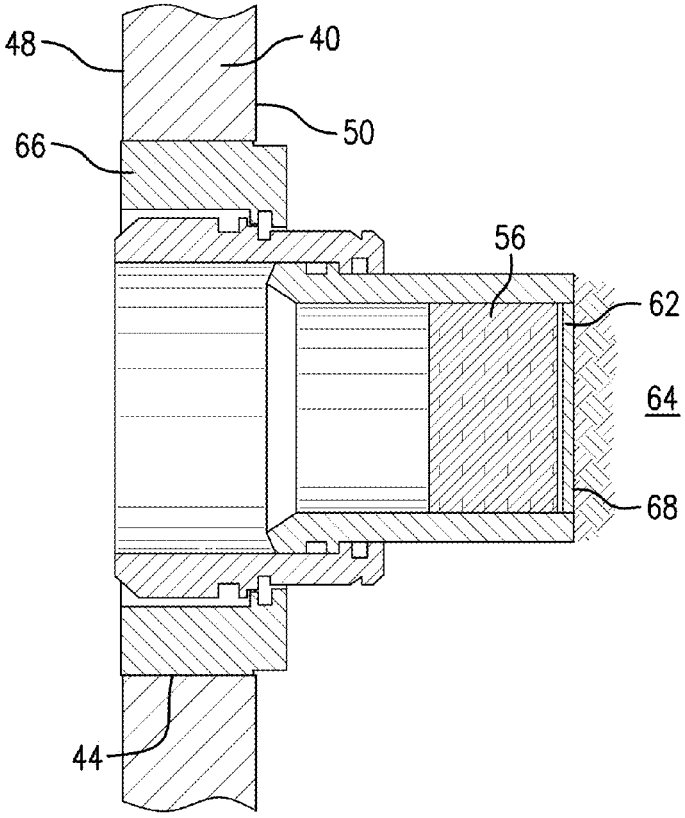

Turning now to FIG. 4, the sand control liner 24, including the plurality of radial apertures 44 that allow for production of fluids from the formation 64 surrounding the lateral borehole 16 into the lateral leg 26, and also including sand control device(s), such as filter pucks 52, that at least substantially prevent the entry of particulates, such as sand, from entering the sand control liner 24 and thus the lateral leg 26, may also or alternatively include telescoping modules 66 that telescope radially from the wall 40, such as via internal pressure, and are engageable with a formation wall 68 of the lateral borehole 16. The telescoping modules 66 may include the filtering elements 56, and additionally the dissolvable membrane 62, therein as previously described. The use of telescoping modules 66 assists in the stabilization of the lateral borehole 16 and the sand control liner 24 within the lateral borehole 16. The sand control liner 16 may include either the filter pucks 52 or the telescoping modules 66, or may include both. The sand control liner 16 at least substantially prevents the entry of sand and other particulates into the interior 46 of the sand control liner 24 and thus into the production fluids produced from the lateral borehole 16.

To further prevent sand migration from the multilateral junction area 12 into the primary borehole 14 during production, an electric submersible pump ("ESP") 70 is run into the multilateral junction device 22 and sealed, such as via a packer 72 or seal bore, into the lateral leg 26 of the multilateral junction device 22, which is uphole of the sand control liner 24. The ESP 70 decreases the pressure at the bottom (downhole portion) of the sand control liner 24 and typically includes at least one electrical motor, and at least one centrifugal pump (not shown). The sealed electric motor of the ESP 70 spins a series of impellers. The production fluid drawn into the intake 74 of the ESP 70 will be pumped through the multilateral junction device 22 to the surface (not shown) in the uphole direction 42. The ESP 70 may be secured to the multilateral junction device 22 and run together into the primary borehole 14 with a power cable (not shown) to the motor strapped alongside the tubing (primary leg 30 and lateral leg 26) of the multilateral junction device 22. The intake 74 of the ESP 70 is in communication with the production fluids in the sand control liner 24, and the discharge 76 of the ESP 70 discharges directly into the multilateral junction device 22, and in particular the uphole end 78 of the lateral leg 26. By sealing the ESP 70 within the lateral leg 26 of the multilateral junction device 22, the discharge end 76 of the ESP 70 may be located directly adjacent the window 32. Because the window 32 substantially spans the inner diameter 34 of the primary borehole 14, at least substantially the full diameter of the primary borehole 14, and thus the surrounding formation wall 80 of the primary borehole 14, is exposed to the discharge of the ESP 70, placing the multilateral junction area 12 under a positive pressure as compared to a pressure downhole of the multilateral junction area 12 in both the lateral and primary boreholes 16, 14. In a further exemplary embodiment, the intake 74 of the ESP 70 is also positioned within the lateral leg 26. FIG. 2 illustrates completion equipment 82 inserted through the window 32 and provided within the primary borehole 14, which is also placed under a positive pressure in the multilateral junction area 12 due to the pumping action of the ESP 70.

When the lateral borehole 16 is placed on production, flow can only feed the ESP 70 through the sand control devices 52 and/or 66 of the sand control liner 24, providing sand control therefrom and preventing damage to and malfunction of the ESP 70. Any vibratory effects of the ESP 70 can be at least partially absorbed by the seal 72 and the lateral leg 26 so as to limit disruption to the sand control liner 24. And as noted above, use of the telescoping modules 66 may further assist in stabilization of the lateral borehole 16, even with the use of the ESP 70. Stabilization of the borehole 16 may further assist in sand management of the sand management system 10. Furthermore, the multilateral junction area 12 is placed under a positive pressure via pumping action of the ESP 70, which at least substantially eliminates sand flow at the multilateral junction area 12. That is, the arrangement of the ESP 70 within the multilateral junction device 22 keeps formation materials in place and out of the flowpath of the multilateral junction area 12. It is further noted that to provide additional sand management, the primary borehole 14 uphole of the multilateral junction area 12 is free of an ESP 70, which would place the multilateral junction area 12 under a negative pressure. The system 10 disclosed herein will limit or at least substantially eliminate sand production from the lateral borehole 16, and sand migration from a multilateral junction area 12 into the main or primary borehole 14 during production from a lateral borehole 16 is prevented or at least substantially prevented.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A multilateral sand management system comprising:

a multilateral junction device disposed at a multilateral junction area of a primary borehole and a lateral borehole, the multilateral junction device including a lateral leg disposed within an upholemost portion of the lateral borehole, a primary bore leg, and a primary bore access window; and, an electric submersible pump disposed within the lateral leg of the multilateral junction device, a discharge end of the electric submersible pump positioned adjacent to the access window, the pump when operating placing the multilateral junction area under a positive pressure compared to a pressure in the lateral borehole and in the primary borehole downhole of the multilateral junction area;

wherein the electric submersible pump is sealed within the lateral leg.

2. The multilateral sand management system of claim 1, wherein the primary bore access window is downhole of the primary bore leg.

3. The multilateral sand management system of claim 2, wherein the primary bore access window substantially spans an inner diameter of the primary borehole at the multilateral junction area.

4. The multilateral sand management system of claim 1, wherein the discharge end of the electric submersible pump is substantially aligned with the access window.

5. The multilateral sand management system of claim 1, wherein an intake and the discharge end of the electric submersible pump are located within the lateral leg.

6. The multilateral sand management system of claim 1, wherein the lateral borehole extends from the primary borehole at an exit opening, and the multilateral junction device includes a hook configured to hang the lateral leg onto the exit opening.

7. The multilateral sand management system of claim 1, further comprising a sand control liner attached to a downhole end of the lateral leg, the sand control liner disposed within the lateral borehole.

8. The multilateral sand management system of claim 7, further comprising an openhole packer contacting a formation wall of the lateral borehole, wherein the sand control liner is sealed within the lateral borehole by the openhole packer.

9. The multilateral sand management system of claim 7, wherein the sand control liner includes a plurality of filter pucks each having a bonded bead pack configured to allow fluid flow through a wall of the sand control liner, and to at least substantially block entry of particulates into the sand control liner.

10. The multilateral sand management system of claim 9, wherein the sand control liner further includes a plurality of telescoping modules extendible to a formation wall of the lateral borehole.

11. The multilateral sand management system of claim 7, wherein the sand control liner further includes a plurality of telescoping modules extendible to a formation wall of the lateral borehole.

12. A method of controlling sand at a multilateral junction area of a primary borehole and a lateral borehole, the multilateral junction area at least substantially spanning an inner diameter of the primary borehole, the method comprising:

positioning a multilateral junction device having a lateral leg, a primary bore leg, and a primary bore access window in the multilateral junction area with the lateral leg of the multilateral junction device within the lateral borehole;

positioning an electric submersible pump into the lateral leg of the multilateral junction device with a discharge end of the electric submersible pump adjacent to the access window; and, placing the multilateral junction area under a positive pressure as compared to a pressure downhole of the multilateral junction area in both the primary borehole and lateral borehole via pumping action of the electric submersible pump;

wherein placing the multilateral junction area under a positive pressure via pumping action of the electrical submersible pump assists in controlling sand at the multilateral junction area by keeping sand out of a flowpath of the multilateral junction area.

13. The method of claim 12, further comprising running a sand control liner into the lateral borehole and extending telescopic modules of the sand control liner against a wall of the lateral borehole.

14. The method of claim 13, wherein the telescopic modules of the sand control liner include a filtering element, and producing through the telescopic modules.

15. The method of claim 12, further comprising sealing the electric submersible pump within the lateral leg.

16. The method of claim 12, further comprising running a sand control liner into the lateral borehole and sealing the sand control liner within the lateral borehole using an openhole packer.

17. The method of claim 12, further comprising hooking the multilateral junction device onto an exit opening for the lateral borehole.

18. The method of claim 12, wherein positioning the multilateral junction device in the multilateral junction area further comprises aligning the primary borehole access window with the primary borehole, the window at least substantially spanning the inner diameter of the primary borehole.

19. The method of claim 18, wherein placing the multilateral junction area under a positive pressure via pumping action of the electric submersible pump includes directing a discharge of the electric submersible pump at the primary borehole access window.

20. The method of claim 12, wherein positioning the electric submersible pump into the lateral leg of the multilateral junction device with the discharge end of the electric submersible pump adjacent to the access window includes positioning the electric submersible pump into the lateral leg of the multilateral junction device with the discharge end of the electric submersible pump directly adjacent to the access window.

21. A multilateral sand management system comprising:

a multilateral junction device disposed at a multilateral junction area of a primary borehole and a lateral borehole, the multilateral junction device including a lateral leg disposed within an upholemost portion of the lateral borehole, a primary bore leg, and a primary bore access window; and, an electric submersible pump disposed within the lateral leg of the multilateral junction device, a discharge end of the electric submersible pump positioned directly adjacent to the access window, the pump when operating placing the multilateral junction area under a positive pressure compared to a pressure in the lateral borehole and in the primary borehole downhole of the multilateral junction area.

* * * * *